US005225819A

United States Patent [19]

Hosotani et al.

[11] Patent Number: 5,225,819

[45] Date of Patent: Jul. 6, 1993

[54] SCREEN DISPLAY DEVICE

[75] Inventors: Osamu Hosotani; Akio Kiji, both of Itami, Japan

[73] Assignee: Mitsubishi Denki Kabushiki Kaisha, Tokyo, Japan

[21] Appl. No.: 450,631

[22] Filed: Dec. 14, 1989

[30] Foreign Application Priority Data

May 12, 1989 [JP] Japan ..... 1-119230

[51] Int. Cl.[5] ..... G09G 1/14

[52] U.S. Cl. ..... 340/750; 340/717

[58] Field of Search ..... 340/721, 748, 750, 730, 340/716, 717; 358/22, 36, 183, 165

[56] References Cited

U.S. PATENT DOCUMENTS

| | | | |
|---|---|---|---|
| 4,278,973 | 7/1981 | Hughes et al. | 340/721 |
| 4,437,092 | 3/1984 | Dean et al. | 340/730 |
| 4,752,773 | 6/1988 | Togawa et al. | 340/721 |
| 4,794,451 | 12/1988 | Suzuki et al. | 340/730 |
| 4,876,533 | 10/1989 | Barkans | 340/721 |

*Primary Examiner*—Ulysses Weldon
*Assistant Examiner*—Matthew Luu
*Attorney, Agent, or Firm*—Townsend and Townsend Khourie and Crew

[57] ABSTRACT

A screen display device which displays characters and patterns on a TV screen or other screen having a separate blanking signal output controlled by set data for each character in the display memory. Different displays can be shown on several different screens by controlling a color signal which combines the set data for each character and the set data for each screen.

9 Claims, 3 Drawing Sheets

SCREEN DISPLAY DEVICE

BACKGROUND OF THE INVENTION

This invention relates to a screen display device for displaying characters and patterns on a TV screen or other device.

Recently, as TVs and VCRs have become more varied, more capable and more user friendly, it has become possible to use characters and patterns to display such information as the current channel and the operating mode on the screen.

FIG. 3 is a block diagram of the design of a conventional screen display device of this type. In FIG. 3, an H counter 1 counts the synchronization signal from the synchronization signal generator circuit (not shown), compares it with the data from the data bus, and detects the character display position. FIG. 3 also depicts screen display oscillator circuit 2; V counter 3 which counts the output clock of screen display oscillator circuit 2, compares it with data from the data bus, and detects the character display position; display position control circuit 4 which uses the outputs of H counter 1 and V counter 3 to control the position of the character display; timing generator 5 which controls the timing of the address counters etc. described below; address counter 6 which outputs the address of the display RAM (display memory) described below; display RAM 7 which stores the addresses of each display color data and character code that is the address of the character ROM (character memory) described below; character ROM 8 stores font data for display characters; shift register 9 converts the output signal of character display ROM 8 into serial data; color signal selection circuit 10 determines the mixing of color signals according to display color data from display RAM 7; bordering signal output circuit 11 outputs bordering data according to the display character font data stored in character ROM 8; shift register 12 converts bordering pattern data from bordering signal output circuit 11 into serial data; and image signal output circuit 13 which outputs a video signal, synchronized with the timing signal from timing generator 5, which comprises, depending upon the output of color signals based on the color signal from color signal selection circuit 10 and font data from character ROM 8 (outputs of shift registers 9 and 12), a red signal from the R (red) terminal, a green signal from the G (green) terminal, a blue signal from the B (blue) terminal, an intensity signal from the I (intensity) terminal, and a blanking signal which erases the background of the character from the OUT terminal and makes the border of a character.

Next the operation of the conventional device is explained. Display position control circuit 4 compares character display position data from the data bus connected to the CPU (not shown) with the values of H counter 1 and V counter 3 to determine the position at which a character is displayed on a screen. Next, according to the outputs of timing generator 5 and display control circuit 4, the contents of address counter 6 are incremented by one for each character and then character type data (address of character ROM 8) and character color data (mixing of the output color signal) which was entered previously in display ROM 7 is read. Color signal selection circuit 10 decodes the read color display data and the output color signal and the selection data are inputted to video signal output circuit 13.

If a border is to be added to the displayed characters, once the shift register 12 has converted the bordering data generated by bordering signal output circuit 11 using character font data from character ROM 8 into serial data b, the serial data b is synchronized with a timing signal from timing generator 5 and a video signal is outputted from the OUT terminal of video signal output circuit 13. In this way a border is created for characters which are displayed on television screens and other types of displays.

By repeating these operations, screen display data is gradually read out from display RAM 7 and character ROM 8 so that a video signal is outputted from video signal output circuit 13.

The conventional screen display device as described above can assign only one type of color signal and blanking signal to each character. Therefore, difficulties arise if two or more screens are displayed on a conventional screen display using a different character output method for each screen, as for example in the case of picture recording, one screen is the original video image, while information needed for the picture recording is displayed on the other screen.

SUMMARY OF THE INVENTION

The object of this invention is to provide a multi-purpose screen display device which, if two or more screens are used, can change the character output method for each screen in order to solve the problems described above.

According to one aspect of the invention there is provided a video display device which includes a memory area (14) in display memory (display RAM 7) for the display mode of each character for each of the several display screens; and a blanking signal control device (15) which, according to the set data, controls the output of the blanking signal to control the blanking signal output from terminal (OUT 2) provided in a video signal output circuit (13).

According to another aspect of the invention there is provided a video display device which includes, in addition to the above, a setting device (register 16) which sets the display mode of each screen; and a color signal control device (18) which controls whether or not a color signal is outputted according to the preset data from memory area (14) in the display memory (display RAM 7) and the aforementioned preset display mode data.

The above and other objects, features, and advantages of this invention will become more apparent from the following description when taken in conjunction with the accompanying drawings.

DESCRIPTION OF THE PREFERRED EMBODIMENT

Figure 1:
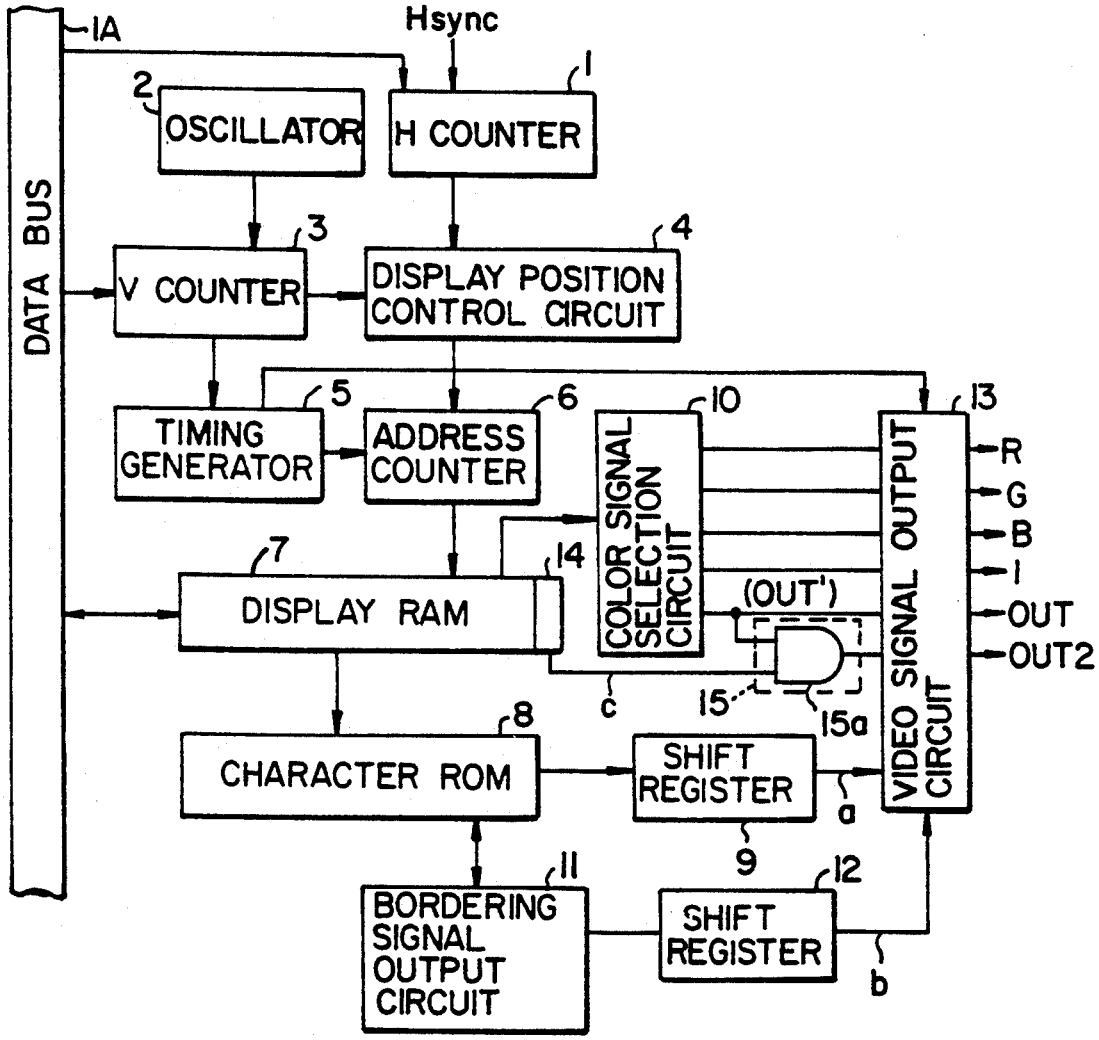
FIG. 1 is a block diagram of a screen display device according to an embodiment of the first invention.
Figure 3:
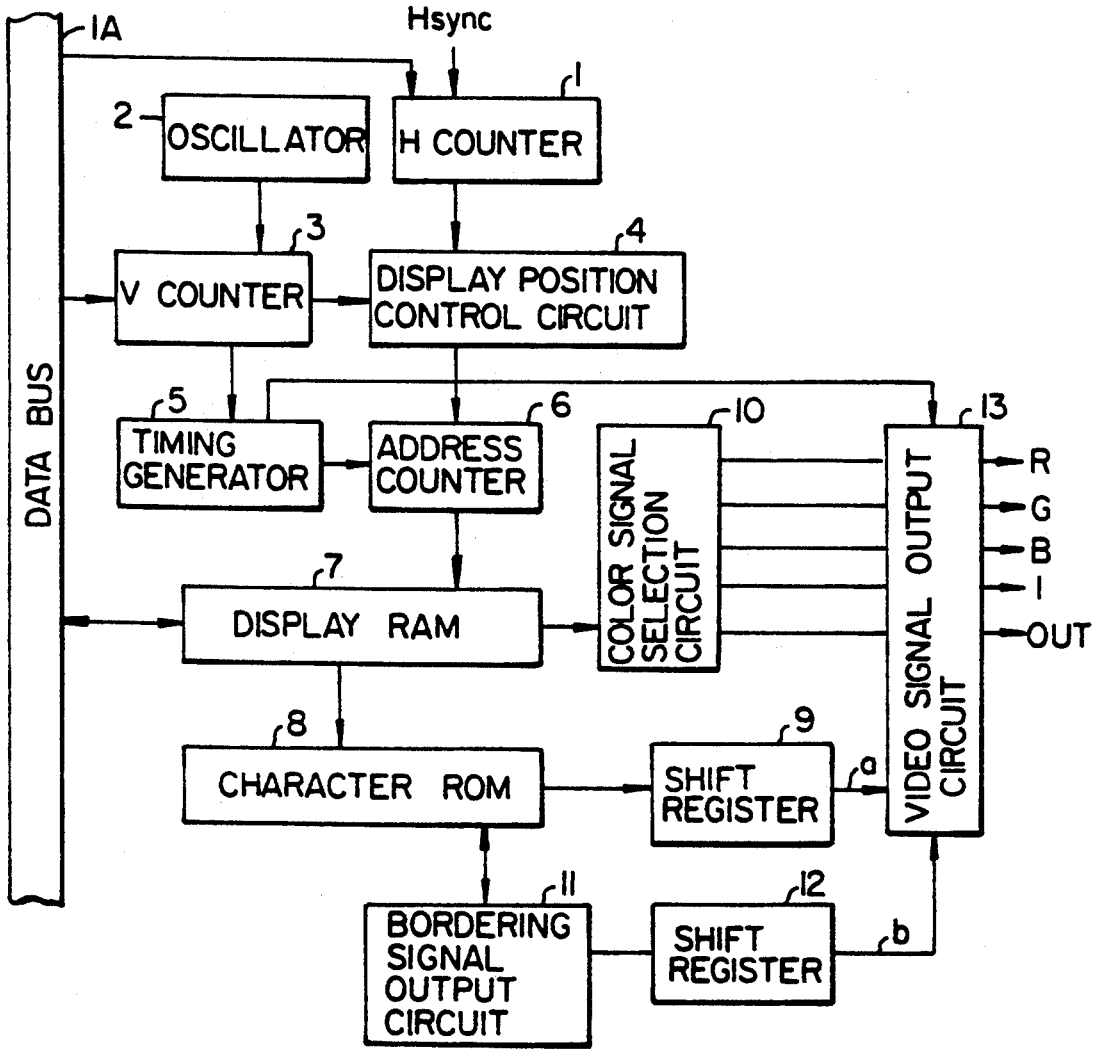
FIG. 3. PRIOR ART
FIG. 3 is a block diagram of a conventional screen display device.

In FIG. 1, a screen display device according to an embodiment of the invention is shown. The parts corresponding to parts of FIG. 3 are represented by the same symbols and are not explained here. The screen display includes a one bit memory area 14 added to each of the addresses in display RAM 7 in which the desired display data for each character is set; a blanking signal control device 15 which, depending upon the data set in memory area 14 of display RAM 7, separately controls whether a blanking signal is outputted which controls character erasure and character bordering; the blanking signal control device 15 consisting of an AND gate 15*a* which takes the logical product of the set data from memory area 14 of display RAM 7 and of the output signal (OUT') of color signal selection circuit 10. This output signal of AND gate 15*a* is outputted through video signal output circuit 13 as second blanking signal from the newly set OUT 2 terminal.

Next, the operation of the screen display device of FIG. 1 is explained. This screen display device is identical to the conventional screen display device of FIG. 3 excepting output signal (OUT') from color signal control circuit 10 which controls the blanking signal and a second blanking signal (OUT 2). Video signal output circuit 13 controls the output of this second blanking signal according to the output signal of AND gate 15*a*, which takes the logical product of output signal (OUT') and the set data c, newly set for this embodiment, from memory area 14 of display RAM 7, and synchronizes the second blanking signal with the timing signal from timing generator 5. The characteristics of this embodiment are explained below.

For example, if characters are displayed on two screens, an intensity signal (I) and a blanking signal (OUT) are inputted to one screen (a monochrome screen for example) and color signals (R,G,B) and a blanking signal (OUT2) are inputted to the other screen (a color screen for example). Accordingly, even though the same characters are displayed on the two screens, if the background of the color characters on the color screen need not be erased or if bordering of those characters on the color screen is not necessary, then by setting the value of the memory area 14 of display RAM 7 to logical zero, the blanking signal outputted from OUT 2 terminal of the video signal output circuit 13 is cancelled and characters having a background or unbordered characters can be displayed as desired. Moreover, if the value of the memory area 14 is set to 1, then the output signal (OUT') of color selection circuit 10 is outputted as is from AND gate 15*a*. Thus the OUT 2 terminal of the video signal output circuit 13 outputs the same blanking signal which was previously outputted from the OUT terminal. In this case, characters which have erased backgrounds or bordered characters are displayed on a color screen.

Since the video signal output circuit 13 has a blanking output controlled by the data set in the display RAM 7, it is possible to select the presence of a blanking output for each screen or character.

Figure 2:
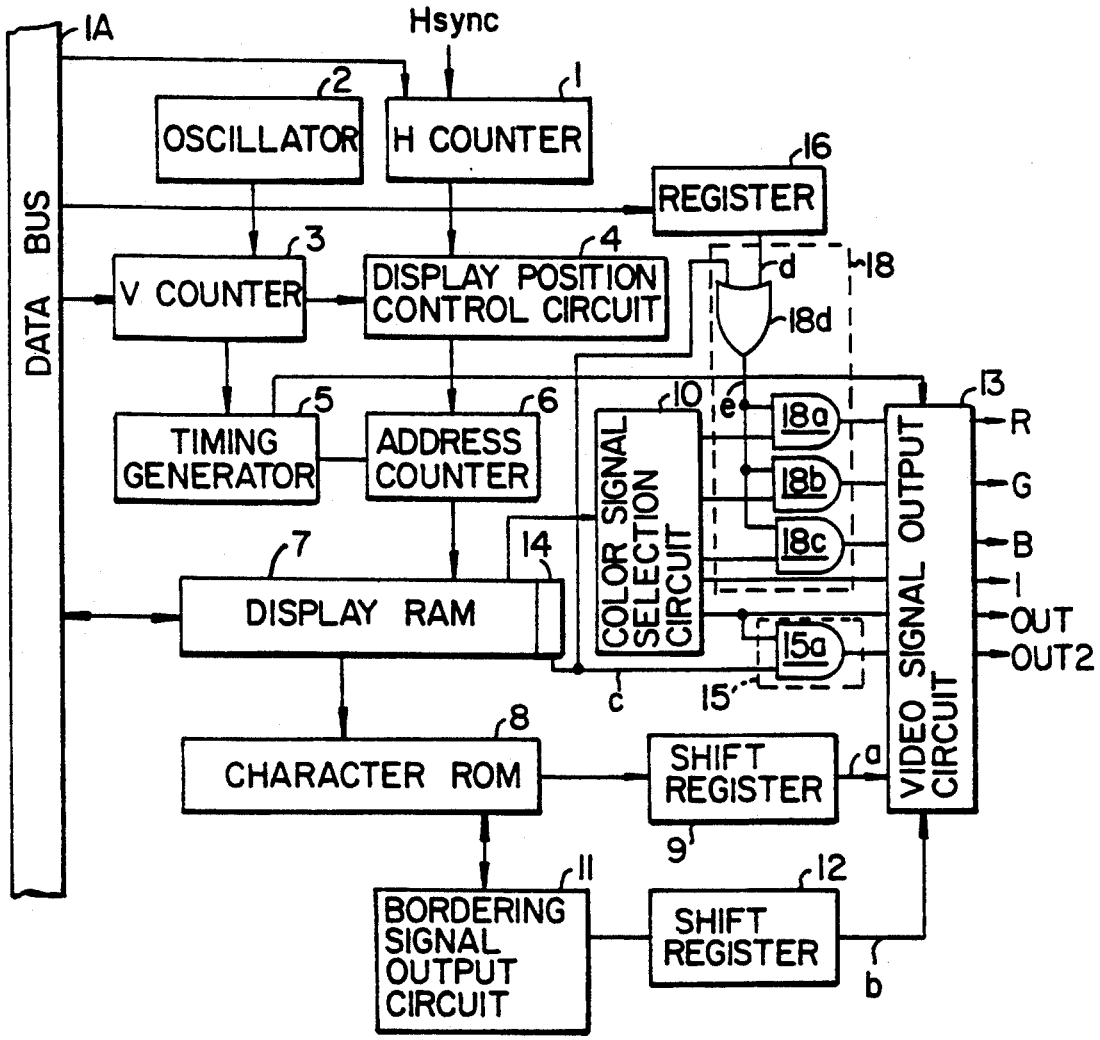
FIG. 2 is a block diagram of a screen display device according to another embodiment of the second invention.

FIG. 2 shows a screen display device according to another embodiment of the invention, wherein elements corresponding to the elements of FIG. 1 are indicated by the same symbols and are not explained here. This screen display device includes one-bit register 16 (set device) which stores data indicating whether to output a color signal to each screen from the data bus connected to the CPU (not shown); and a color signal control device 18 which, depending upon the output signal produced by mixing the set data from memory area 14 of display RAM 7 which controls blanking signal control device 15 with the set data from register 16, controls whether a color signal output is sent to video signal output circuit 13 from color selection circuit 10. Color signal control device 18 is composed of OR gate 18*d* which takes the logical sum of set data d of register 16 with set data c of memory area 14 in display RAM 7 as well as AND gates 18*a*, 18*b* and 18*c* which take the logical product of each output signal (color signal) of color selection circuit 10 with the output signal e of the OR gate 18*d*.

Next the operation of the screen display device shown in FIG. 2 is explained. This screen display device operates the same way as the embodiment of FIG. 1 except that color signals are outputted from terminals R, G, and B of video signal output circuit 13 after the signal output from the color signal selection circuit 10 is controlled by the AND gates 18*a*, 18*b*, and 18*c* in response to the output e from the OR gate 18*d* which takes a logical sum of the data d from the register 16 in which information for designating the presence of a color signal from the data bus and the data c from the memory area 14 of the display RAM 7 which controls the second blanking signal output at the OUT 2 terminal from the video signal output circuit 13. The operation of the embodiment shown in FIG. 2 are explained below.

If the value of register 16 is set to logical 1, then the output signal e of OR gate 18*d* is logical 1, and the color signals (R,G,B) outputted by the color signal selection circuit 10 are sent unchanged through AND gates 18*a*, 18*b* and 18*c* to video signal output circuit 13 so as to display characters, etc. on a color display. Moreover, if register 16 is set to logical 0, then the output signal e of OR gate 18*d* becomes the same as the data in memory area 14 in display RAM 7. ANDing this data with the output signal of color signal selection circuit 10 by AND gates 18*a*, 18*b*, and 18*c* controls the color signal which is outputted at the R, G, and B terminals of video signal output circuit 13.

For example, if characters are displayed on two screens, an intensity signal (I) and a blanking signal (OUT) are inputted to one screen (a monochrome screen for example) and color signals (R,G,B) and a blanking signal (OUT2) are inputted to the other screen (a color screen for example). Accordingly, even though the same characters can be displayed on the two screens, if there is a character which you do not want to display on the color screen, then by setting register 16 to logical 0 and setting the value of memory area 14 of display RAM 7 to logical 0, the output signals of AND gates 18*a*, 18*b*, and 18*c* go to logical 0, the color signals (R,G,B) are not outputted, and the character is not displayed.

As shown by the embodiment of FIG. 2, the video signal output circuit 10 can be controlled by the color signal generated by combining the set data in display RAM 7 with the set data in register 16. This makes it possible to select whether or not to output a color signal to each screen and to each character, that is, whether to output a given character.

Although the case of two blanking signals for two screens is described in the embodiments above, three screens (all color screens) can be accommodated by the control device employed in this design by increasing the number of set bits and of blanking signal output terminals and by setting three or more blanking signals. Moreover, although AND gates are used as the blanking signal control device in the embodiments above, the same function can be performed by other logic circuits.

According to one aspect of the invention, as described above, since several separate outputs are provided for the blanking signals controlled by data from display memory, if data is displayed on two or more screens, the character output method can be changed in single character units depending upon whether or not a blanking signal is outputted. This increases the potential applications of the screen display device.

Moreover, according to another aspect of the invention, because it has a configuration which controls whether a color signal is outputted depending upon the data created by combining data from the display memory with data from a fixed device, if data is to be displayed on two or more screens, the character output method can be changed in single character units depending upon whether or not each blanking signal is outputted. Moreover, by using the combined data to control whether or not a color signal is outputted as described above, characters displayed on each screen can be selected in single character units. This increases the range of applications for this screen display device.

What is claimed is:

1. A screen display device comprising:

a display memory in which code and display color data for each character or pattern to be displayed on a screen is stored and from which said code and display color data is read out according to an address based on a display position;

a character memory in which font data for said character or pattern is stored and from which said font data is read out according to said character code read from said display memory;

a color signal selection circuit for determining a combination of color signals based on said display color data from said display memory;

a video signal output circuit having a color signal output terminal and a blanking signal output terminal which controls character background erasure and character bordering, which outputs with a predetermined timing a video signal according to a color signal from said color signal selection circuit and font data from said character memory;

a memory area in said display memory for storing set data about a display mode of each character on several display screens; and blanking signal control means responsive to said set data to control output of said blanking signal at a separate blanking signal output terminal in said video signal output circuit.

2. The screen display device of claim 1, wherein said video signal output circuit comprises an R terminal for outputting a red signal, a G terminal for outputting a green signal, a B terminal for outputting a blue signal, an I terminal for outputting an intensity signal, an OUT terminal for outputting a blanking signal, and an OUT 2 terminal for outputting a second blanking signal, said R, G, B, I, and OUT terminal being selected by the corresponding signal from said color signal selection circuit;

said memory area in said display memory stores one bit which is appended to each display address in said display memory; and said blanking signal device comprises an AND circuit which takes a logical product of a signal outputted from said color signal selection circuit to select said OUT terminal and set data read from said memory area of said display memory and outputs the resultant signal to the video signal output circuit in order to select the OUT 2 terminal.

3. The screen display device of claim 1, which further includes setting means for setting a display mode of each screen and color signal control means which controls whether a color signal is outputted on the basis of set data from said display mode and set data from said memory area of said display memory.

4. The screen display device of claim 3, wherein said video signal output circuit comprises an R terminal for outputting a red signal, a G terminal for outputting a green signal, a B terminal for outputting a blue signal, an I terminal for outputting an intensity signal, an OUT terminal for outputting a blanking signal, and an OUT 2 terminal for outputting a second blanking signal, said R, G, B, I, and OUT being selected by the corresponding signal from said color signal selection circuit;

said memory area in said display memory stores one bit which is appended to each display address in said display memory;

said blanking signal means comprising an AND circuit which takes a logical product of a signal outputted from said color signal selection circuit to select said OUT terminal and set data read from said memory area of said display memory and outputs the resultant signal to said video signal output circuit in order to select said OUT 2 terminal;

said setting means comprising a one-bit register;

said color signal control means comprising an OR gate that takes a logical sum of set data from said register and set data read from said memory area of said display memory and an AND gate which takes a logical product of each signal outputted from said color signal selection circuit or select said R, G and B terminals and an output of said OR gate and outputs to the video signal output circuit a signal for selecting said R, G, or B terminal.

5. The screen display device of claim 1 or 3, which further includes a bordering signal output circuit for outputting bordering pattern data corresponding to font data outputted from said character memory;

said video signal output circuit outputting a video signal with predetermined timing in response to a color signal from said color signal selection circuit, font data from said character memory and bordering pattern data from said bordering signal output circuit.

6. A screen display device comprising:

a display memory in which code and display color data for each character or pattern to be displayed on a screen is stored and from which said code and display color data is read out according to an address based on a display position;

a character memory in which font data for said character or pattern is stored and from which font data is read out according to said character code read from said display memory;

a color signal selection circuit for determining a combination of color signals based on said display color data from said display memory;

a video signal output circuit having a color signal output terminal and a blanking signal output terminal which controls character background erasure and character bordering, which outputs with a predetermined timing a video signal according to a color signal from said color signal selection circuit and font data from said character memory;

a memory area in said display memory for setting data about a display mode of each character on several display screens; and blanking signal control means responsive to said set data control output of said blanking signal at a separate blanking signal output terminal in said video signal output circuit;

wherein said video signal output circuit comprises an R terminal for outputting a red signal, a G terminal for outputting a green signal, a B terminal for outputting a blue signal; and an OUT terminal for outputting a second blanking signal, said R, G, B, I and OUT terminals being selected by the corresponding signal from said color signal selection circuit;

wherein said memory area in said display memory is made by adding one bit to each display address in said display memory; and said blanking signal device is composed of an AND circuit which takes a logical product of a signal outputted from said color signal selection circuit to select said OUT terminal and set data read from said memory area of said display memory and outputs the resultant signal to the video signal output circuit in order to select the OUT 2 terminal.

7. The screen display device of claim 6, further including setting means for setting a display mode of each screen and color signal control means which controls whether a color signal is outputted on the basis of set data from said display mode and set data from said memory area of said display memory;

wherein said video signal output circuit comprises an R terminal for outputting a read signal, a G terminal for outputting a green signal, a B terminal for outputting a blue signal, an I terminal for outputting an intensity signal, an OUT terminal for outputting a blanking signal, and an OUT 2 terminal for outputting a second blanking signal, said R, G, B, I, and OUT terminals being selected by the corresponding signal from said color signal selection circuit;

wherein said memory area in said display memory is made by adding one bit to each display address in said display memory;

said blanking signal means being composed of an AND circuit which takes a logical product of a signal outputted from said color signal selection circuit to select said OUT terminal and set data read from said memory area of said display memory and outputs the resultant signal to said video signal output circuit in order to select said OUT 2 terminal;

said setting means consisting of a one-bit register; and said color signal control means consisting of an OR gate that takes a logical sum of set data from said register and set data read from aid memory area of said display memory and an AND gate which takes a logical product of each signal outputted form said color signal selection circuit to select said R, G and B terminals and an output of said OR gate and outputs to the video signal output circuit a signal for selecting said R, G, or B terminal.

8. A screen display device comprising:

a data bus for transferring character, pattern, and color data for each character or pattern to be displayed on a screen;

a display memory for storing character codes and color data, and from which said character codes and color data are read out according to an address based on a display position;

a character memory in which font data for said character code is stored and from which display pattern data are read out according to said character code read from said display memory;

a color signal selection circuit operable in response to said color data to generate a combination of color signals, an intensity signal for displaying characters, and a blanking signal for character background erasure and character bordering; and a video signal output circuit operable in response to said combination of color signals to generate a plurality of display color signals, operable in response to said intensity signal and to said font data to generate a character intensity signal, and operable in response to said blanking signal to generate a first blanking signal in a predetermined timing characterized in that the device comprises a 1-bit memory area in said display memory for storing specification data for specifying character background erasure and for character bordering for several screens, and blanking signal control means comprising an AND circuit operable in response to said specification data and to said blanking signal to generate a logical product signal of these signals, said video signal output circuit operable in response to said logical product signal to generate a second blanking signal to be input to another screen, said second blanking signal being different from said first blanking signal.

9. The screen display device of claim 8 further including setting means which comprises a one-bit register for storing set data from said data bus for setting a display mode for each screen, and a color signal control means comprising an OR gate for outputting a logical product signal of said set data from said setting means and said specification data from said one-bit memory area and an AND gate for outputting a logical product signal of said logical product signal from said OR gate and each color data as a plurality of said display color signals for determining a display mode.

* * * * *